US005554494A

United States Patent [19]

Shiratsuchi et al.

[11] Patent Number: 5,554,494

[45] Date of Patent: Sep. 10, 1996

[54] SILVER HALIDE PHOTOGRAPHIC MATERIAL COMPRISING EMULSION LAYER AND HYDROPHOBIC BACKING LAYER PROVIDED ON SUPPORT

[75] Inventors: Kentaro Shiratsuchi; Tsukasa Yamada; Satoru Toda, all of Kanagawa, Japan

[73] Assignee: Fuji Photo Film Co., Ltd., Kanagawa, Japan

[21] Appl. No.: 494,070

[22] Filed: Jun. 23, 1995

[30] Foreign Application Priority Data

Jun. 23, 1994 [JP] Japan ..... 6-141479

[51] Int. Cl.[6] ..... G03C 1/76

[52] U.S. Cl. ..... 430/523; 430/531; 430/534; 430/535; 430/930

[58] Field of Search ..... 430/523, 930, 430/529, 531, 534, 535

[56] References Cited

U.S. PATENT DOCUMENTS 4,497,917 2/1985 Upson et al. ..... 523/201

*Primary Examiner*—Thorl Chea

*Attorney, Agent, or Firm*—Sughrue, Mion, Zinn, Macpeak & Seas

[57] ABSTRACT

A silver halide photographic material comprising a silver halide emulsion layer and a hydrophobic backing layer provided on a support. The hydrophobic backing layer is formed by coating core/shell polymer particles. The core comprises a cross-linked polymer. The shell comprises an essentially not cross-linked polymer.

16 Claims, 1 Drawing Sheet

SILVER HALIDE PHOTOGRAPHIC MATERIAL COMPRISING EMULSION LAYER AND HYDROPHOBIC BACKING LAYER PROVIDED ON SUPPORT

FIELD OF THE INVENTION

The present invention relates to a silver halide photographic material. The invention more particularly relates to a silver halide photographic material comprising a silver halide emulsion layer and a hydrophobic backing layer provided on a support.

BACKGROUND OF THE INVENTION

A silver halide photographic material, usually comprises a silver halide emulsion layer and an anticurl backing layer provided on a support.

The silver halide emulsion layer comprises silver halide grains dispersed in a hydrophilic binder such as gelatin. The emulsion layer absorbs the moisture because the hydrophilic binder is hygroscopic. Therefore, the photographic material tends to be curled according to the change of the humidity. The curled photographic material causes a jam while conveying the material in an automatic processing machine.

An anticurl (non-curling) backing layer is usually provided on the reverse side of the support to prevent the photographic material from curling. The anticurl backing layer contains a hydrophilic binder. The hygroscopic property of the anticurl backing layer is analogous to that of the emulsion layers. The curling force caused by the emulsion layer is balanced with the reverse curling force caused by the anticurl backing layer.

By the way, a recent silver halide photography requires rapid processes, namely a rapid development process, a rapid fixing process, a rapid washing process and a rapid drying process. The requirement of speedup is severe particularly in printing technical fields. The rapid process is also required to reduce the amounts of the waste processing solutions. Therefore, the silver halide photographic material has recently been improved to shorten the processing time.

The above-mentioned anticurl backing layer causes problems in the rapid processes of the photographic material. For example, the hydrophilic binder of the anticurl backing layer absorbs water contained in the processing solutions. A relatively long time is required to dry the layer absorbing water. Further, the amount of a replenisher should be increased to compensate the absorbed water.

Furthermore, even if the anticurl backing layer is removed from the photographic material, the problem remains. The support in place of the anticurl backing layer absorbs water in the processing solutions. The support absorbing water loses the dimensional stability.

European Patent Publication No. 107378A1, Japanese Patent Provisional Publication Nos. 56(1981)-17352, 59(1984)-218438, 5(1993)-127282(corresponding to U.S. Pat. No. 5,219,718 and European Patent Publication No. 514903A1) and 5(1993)-127306 propose a silver halide photographic material having a hydrophobic backing layer provided on the anticurl backing layer or the support to solve the above-mentioned problems caused by water contained in the processing solutions. The hydrophobic backing layer contains a hydrophobic polymer, which has a function of shielding the anticurl backing layer or the support from the processing solutions. The layer disclosed in European Patent Publication No. 107378A1, Japanese Patent Provisional Publication Nos. 56(1981)-17352 and 59(1984)-218438 are formed by fusing core/shell polymer particles together.

SUMMARY OF THE INVENTION

The applicants note that the shielding functions of the hydrophobic backing layers disclosed in European Patent Publication No. 107378A1, Japanese Patent Provisional Publication Nos. 56(1981)-17352, 59(1984)-218438, 5(1993)127282 and 5(1993)-127306 are still insufficient. The hydrophobic polymers should be further improved to solve the problems caused by the processing solutions. Further, some hydrophobic polymers disclosed in the Publications cause a crack in the hydrophobic backing layer or make the layer adhesive.

An object of the present invention is to provide a silver halide photographic material having a hydrophobic backing layer which sufficiently shields an anticurl backing layer or a support from processing solutions.

Another object of the invention is to provide a photographic material which can be quickly dried at a drying process.

A further object of the invention is to provide a photographic material which is scarcely curled, and does not cause a jam while conveying the material in an automatic processing machine.

A furthermore object of the invention is to provide a photographic material which merely requires small amounts of processing solutions and replenishers.

A still further object of the invention is to provide a photographic material having a hydrophobic backing layer which is free from the problems of the crack or the adhesion.

The present invention provides a silver halide photographic material comprising a silver halide emulsion layer and a hydrophobic backing layer provided on a support, said hydrophobic backing layer being formed by coating core/shell polymer particles, wherein the core comprises a cross-linked polymer, and the shell comprises an essentially not cross-linked polymer.

The applicants find that the layer formed from the above-mentioned core/shell particles has an excellent function of shielding the anticurl backing layer or the support from the processing solutions.

The applicants found that a cross-linked polymer improves a water-resistance of a hydrophobic backing layer. However, it is difficult to coat a cross-linked polymer to form the backing layer because the cross-linked polymer is too hard to form the layer. A layer of the cross-linked polymer can be formed by coating an essentially not cross-linked polymer with a hardening (cross-linking) agent. However, the applicants note that the shielding function of the polymer cross-linked with the hardening agent is inferior to the function of an inherently or previously cross-linked polymer.

The applicants now solve the problems by the above-mentioned core/shell particles. The shell comprising an essentially not cross-linked polymer can be fused by coating the particles to form a backing layer. The core comprising a cross-linked polymer can introduce the cross-linked structure into the hydrophobic backing layer.

According to the present invention, the anticurl backing layer or the support scarcely absorbs water contained in the processing solution. Therefore, the photographic material of the present invention can be quickly dried at a drying process. Further, the photographic material merely requires small amounts of processing solutions and replenishers.

The hydrophobic backing layer of the present invention does not inhibit the function of the anticurl backing layer. Accordingly, the photographic material of the present invention is scarcely curled, and does not cause a jam while conveying the material in an automatic processing machine. Further, the hydrophobic backing layer of the present invention is free from the problems of the crack or the adhesion.

DETAILED DESCRIPTION OF THE INVENTION

Figure 1:
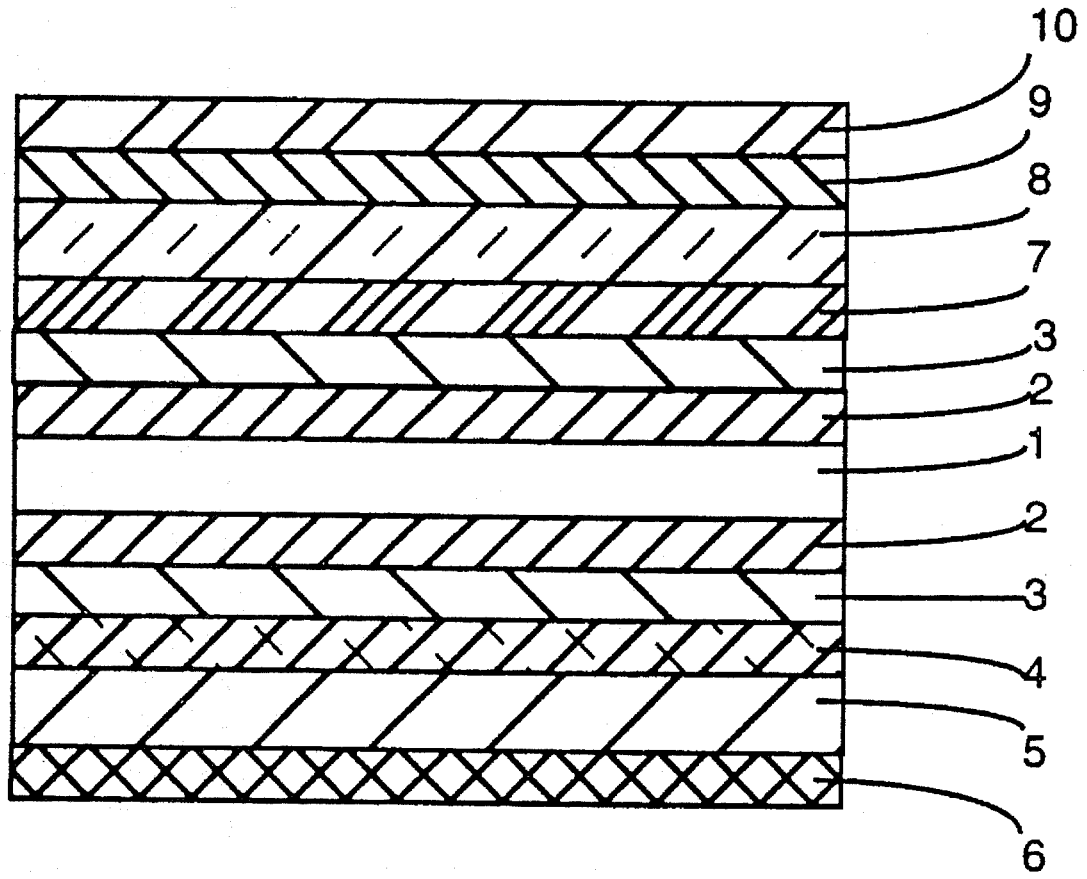
FIG. 1 is a sectional view schematically illustrating a preferred embodiment of the photographic material of the present invention.

The present invention is characterized in that the hydrophobic backing layer is formed by coating core/shell polymer particles and the core comprising a cross-linked polymer.

The cross-linked polymer of the core preferably is a copolymer made from a monomer having one ethylenically unsaturated group and another monomer having two or more ethylenically unsaturated groups.

The latter monomer forms the cross-linked structure in the core polymer. The monomer having two or more ethylenically unsaturated groups is preferably used in the amount of 1 to 35 wt. %, more preferably used in the amount of 5 to 20 wt. % based on the total amount of the monomers.

The monomers having two or more ethylenically unsaturated groups include an ester of a diol or a triol with acrylic acid or methacrylic acid, divinylbenzene, N,N'-alkylenebisacrylamide and N,N'-alkylenebismethacrylamide.

In more detail, examples of such monomers include divinylbenzene, 4,4'-isopropylidenediphenylene diacrylate, 1,3-butylene diacrylate, 1,3-butylene dimethacrylate, 1,4-cyclohexylenedimethylene dimethacrylate, diethyleneglycol dimethacrylate, diisopropylideneglycol dimethacrylate, divinyloxymethane, ethyleneglycol diacrylate, ethyleneglycol dimethacrylate, ethylidene diacrylate, ethylidene dimethacrylate, 1,6-diacrylamidohexane, N,N'-methylenebisacrylamide, N,N'-(1,2-dihydroxy)ethylenebisacrylamide, 2,2-dimethyl-1,3-trimethylene dimethacrylate, phenylethylene dimethacrylate, tetraethyleneglycol dimethacrylate, tetramethylene diacrylate, tetramethylene dimethacrylate, 2,2,2-trichloroethylidene dimethacrylate, triethyleneglycol diacrylate, pentaerythrytol triacrylate, trimethylolpropane triacrylate, tetramethylolmethane tetracrylate, triethyleneglycol dimethacrylate, 1,3,5-triacryloylhexanehydro-s-triazine, bisacrylamidoacetic acid, ethylidyne trimethacrylate, propylidyne triacrylate and vinylallyl oxyacetate.

Ethyleneglycol dimethacrylate, divinylbenzene, N,N'-methylenebisacrylamide, trimethylolpropane trimethacrylate, triethyleneglycol dimethacrylate, tetraethyleneglycol dimethacrylate and 1,3-butanediol dimethacrylate are preferred.

The monomer having one ethylenically unsaturated group is preferably used in the amount of 65 to 99 wt. %, more preferably used in the amount of 80 to 95 wt. % based on the total amount of the monomers.

The monomer having one ethylenically unsaturated group preferably further has an alicyclic group having 3 to 16 carbon atoms. The preferred alicyclic monomer is represented by the following formula (I).

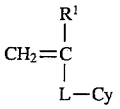

(I)

In the formula (I), $R^1$ is hydrogen or an alkyl group having one to four carbon atoms, and preferably is hydrogen or methyl.

L is a divalent linking group selected from the group consisting of —CO—, —O—, —$NR^2$—, phenylene, an alkylene group having one to three carbon atoms and combinations thereof. The alkylene group may be substituted with hydroxyl or a halogen atom. Examples of the divalent linking groups formed by the combinations are shown below.

L1: —CO—O—

L2: —$CONR^2$—

L3: -phenylene-alkylene—

L4: —CO—O-alkylene—

L5: —CO—O-alkylene-O—CO—

$R^2$ is hydrogen or an alkyl group having one to four carbon atoms, and preferably is hydrogen.

Cy is an alicyclic group consisting of a monocyclic ring. The monocyclic ring means that the ring does not contain a bridgehead carbon atom. Accordingly, a condensed ring and a spiro-ring are not included in the monocyclic ring. Cy preferably is a cycloalkyl group or a cycloalkenyl group, and more preferably is a cycloalkyl group.

Cy has three to sixteen carbon atoms, preferably five to ten carbon atoms. The number of the carbon atoms means the total number of the carbon atoms of Cy including the carbon atoms contained in the ring and the atoms contained in substituent groups. Cy may be substituted with an alkyl group (including a cycloalkyl group), an alkenyl group (including a cycloalkenyl group) or a halogen atom.

Examples of the alicyclic groups include cyclopropyl, cyclobutyl, cyclopentyl, cycloheryl, cycloheptyl, cyclooctyl, cyclodecyl, cyclododecyl, 1-methylcyclohexyl, 2-methylcyclohexyl, 3-methylcyclohexyl, 4-methylcyclohexyl, 2-cyclohexylcyclohexyl, 4-cyclohexylcyclohexyl, 2-ethylcy-clohexyl, 4-ethylcyclohexyl, 2-n-propylcyclohexyl, 4-t-butylcyclohexyl, 2,3-dimethylcyclohexyl, 2,6-dimethylcyclohexyl, 3,4-dimethylcyclohexyl, 3,5-dimethylcyclohexyl, 2-chlorocyclohexyl, 1-cyclohexenyl, 2-cyclohexenyl, 2-cyclohexenyl and 3-cylcohexyenyl. Cyclopentyl, cyclohexyl, cycloheptyl, cyclooctyl, 2-methylcyclohexyl and 2-cyclohexenyl are preferred.

The monomer having one ethylenically unsaturated group also preferably further has an (acyclic) alkyl group having 1 to 6 carbon atoms. The alkyl group may have a branched structure. Examples of the monomer having the ethylenically unsaturated (alkenyl) group and the alkyl group include methyl methacrylate, ethyl methacrylate, n-propyl methacrylate, isopropyl methacrylate, n-butyl methacrylate, sec-butyl methacrylate, tert-butyl methacrylate, 2-methylpentyl methacrylate, 4-methyl-2-pentyl methacrylate, 2-ethylbutyl methacrylate and 3,3-dimethyl-2-butyl methacrylate. Particularly, n-propyl methacrylate, n-butyl methacrylate, sec-butyl methacrylate and tert-butyl methacrylate are preferred.

The other monomers having one ethylenically unsaturated group can also be used in the cross-linked polymer of the core. Examples of the other monomers include acrylic acid, methacrylic acid, acrylic esters (e.g., methyl acrylate, ethyl acrylate, n-propyl acrylate, iso-propyl acrylate, n-butyl acrylate, benzyl acrylate, 2-ethylhexyl acrylate), methacrylic esters (e.g., benzyl methacrylate), acrylamides (e.g., n-butylacrylamide, t-butylacrylamide), methacrylamides, vinyl esters (e.g., vinyl acetate), acrylonitrile, methacrylonitrile, dienes (e.g., butadiene, isoprene), aromatic vinyl compounds (e.g., styrene, p-chlorostyrene, t-butylstyrene, α-methylstyrene, chloromethylstyrene) and alkenes (e.g., ethylene, propylene, 1-butene, isobutene). The ethylenically unsaturated monomers are described in Research Disclosure No. 19551 (July 1980).

Two or more polymers can be used in combination.

Examples of the core polymers (repeating units) are shown below. The ratio of the monomers shown in a copolymer means the weight ratio.

(CP-1)

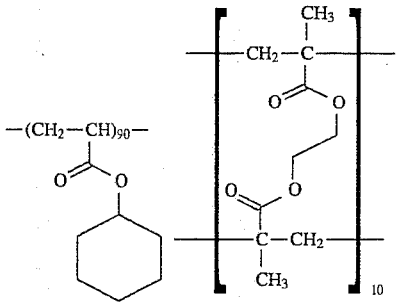

(CP-2)

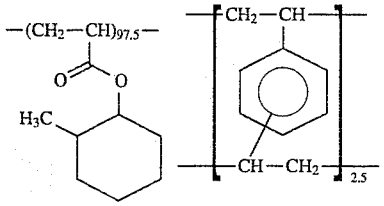

(CP-3)

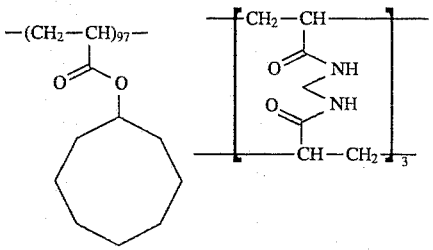

(CP-4)

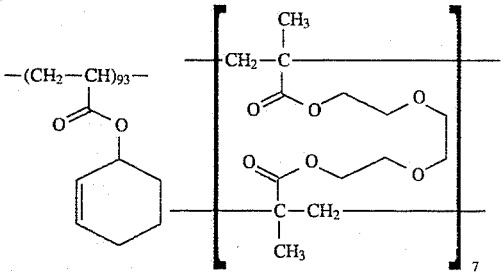

-continued (CP-5)

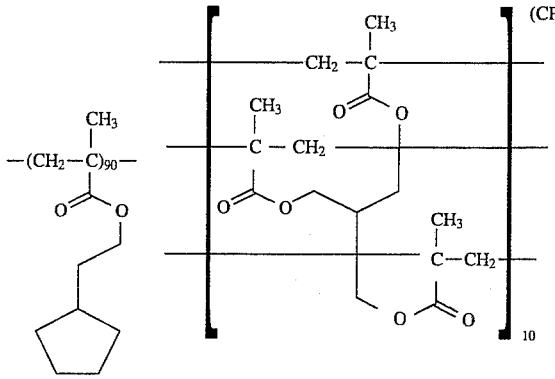

(CP-6)

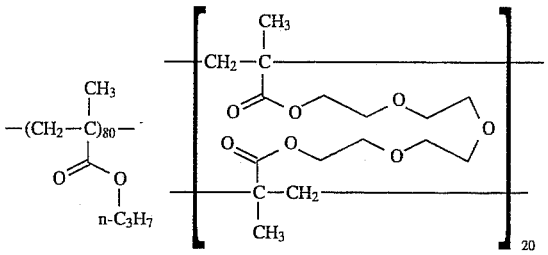

(CP-7)

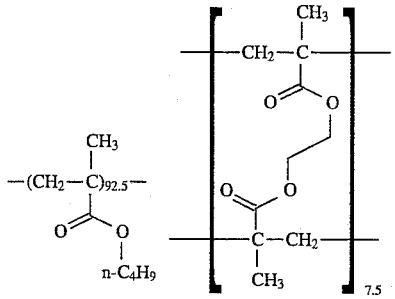

(CP-8)

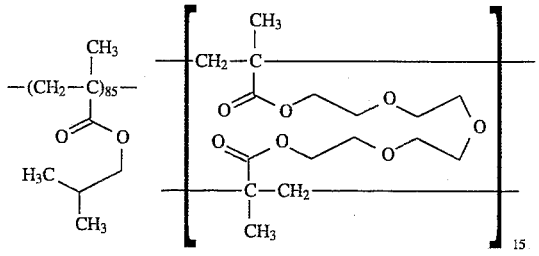

-continued
(CP-9)
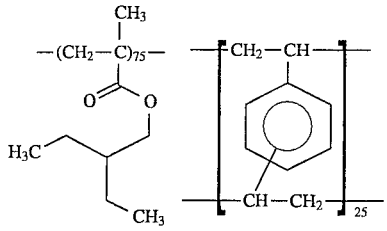
(CP-10)
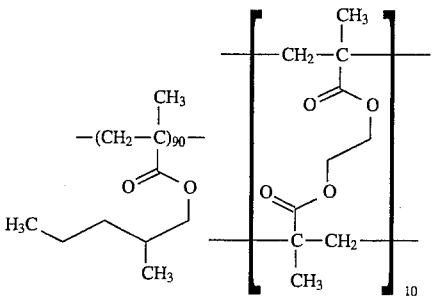
(CP-11)
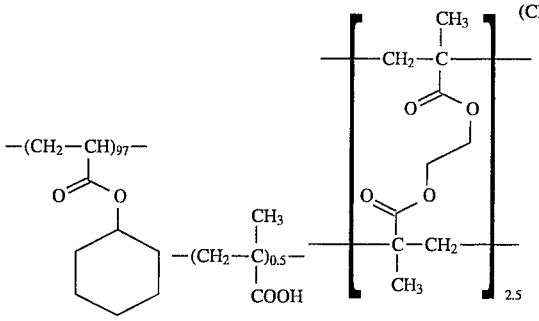
(CP-12)
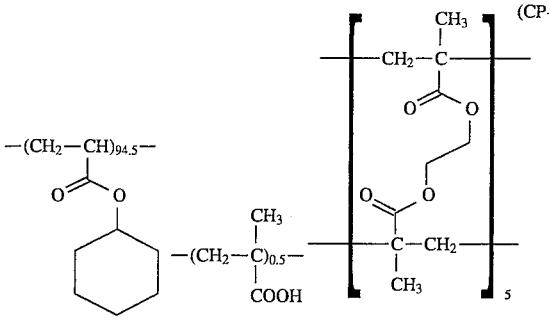
(CP-13)
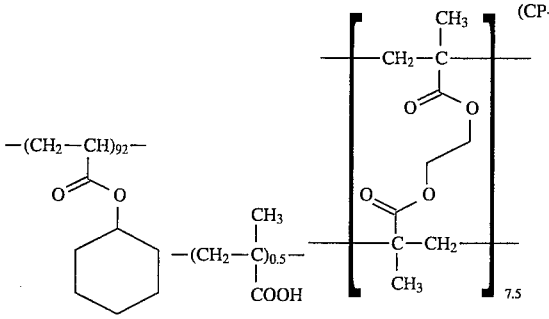
-continued
(CP-14)
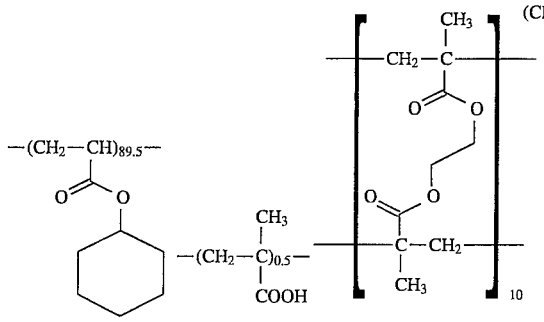
(CP-15)
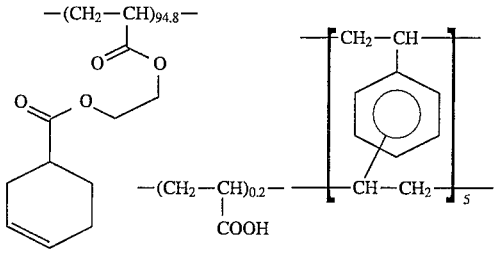
(CP-16)
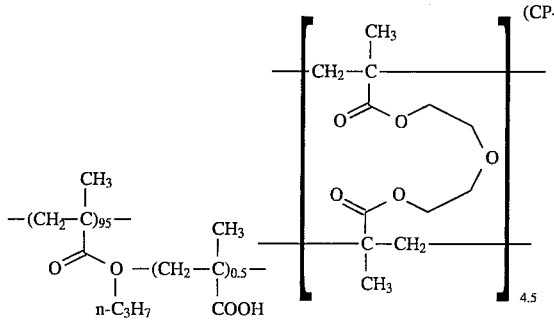
(CP-17)
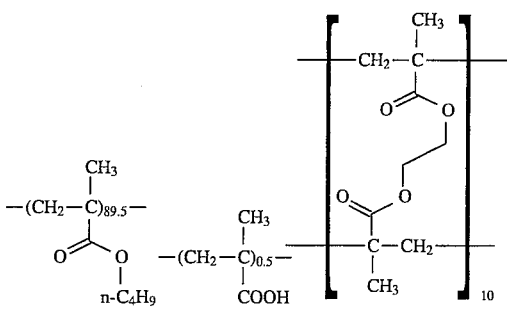
(CP-18)
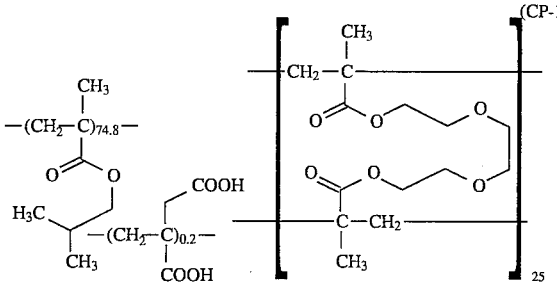

-continued (CP-19)

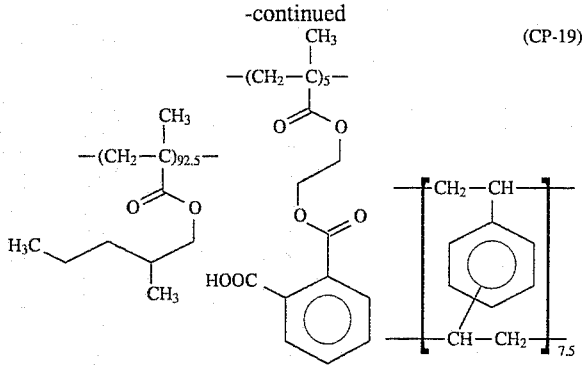

(CP-20)

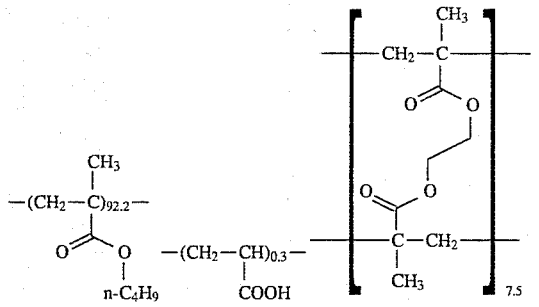

(CP-21)

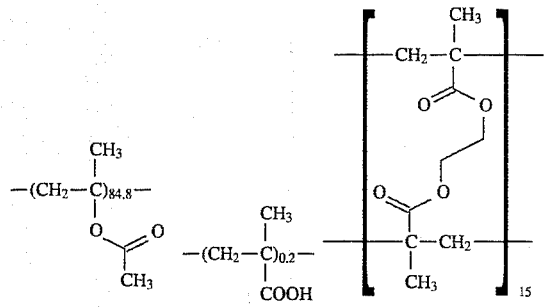

(CP-22)

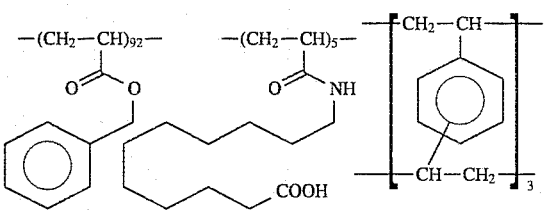

(CP-23)

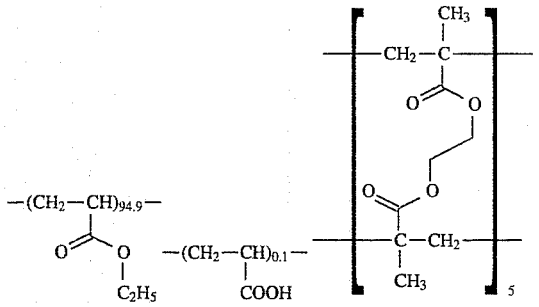

-continued (CP-24)

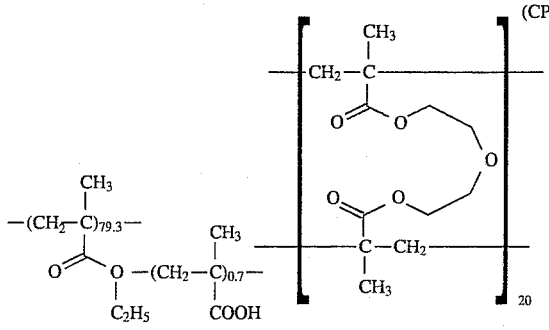

(CP-25)

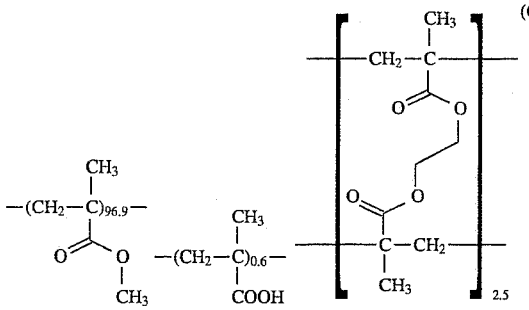

The molecular weight of the core polymer is limitless, and usually is extremely large because the polymer is cross-linked.

The cross-linked polymer of the core preferably has a glass transition temperature in the range of 10° to 65° C., and more preferably in the range of 20° to 50° C.

The amount of the core is preferably in the range of 50 to 98 wt. %, and more preferably in the range of 60 to 95 wt. % based on the total amount of the particle.

The shell of the particles comprises an essentially not cross-linked polymer. The term "essentially not cross-linked" means that the cross-linking degree of the polymer is less than 0.1 mmol/g. The cross-linking degree is preferably less than 0.05 mmol/g. The particles are fused only by coating a latex containing the particles because the shell polymer is essentially not cross-linked.

The shell preferably has a hydrophilic group such as carboxyl, a heterocyclic group, an ester bond or an amido bond in its side chain. The shell polymer preferably is a copolymer made from a hydrophilic ethylenically unsaturated monomer (e.g., acrylic acid, methacrylic acid, N-vinyl pyrrolidone with another ethylenically unsaturated monomer. The hydrophilic monomer is preferably used in the amount of not less than 5 wt. % based on the total amounts of the monomers. The hydrophilic monomer is preferred particularly in the case that the hydrophilic backing layer and the anticurl backing layer are simultaneously coated on the support. The hydrophilic monomer has a function of preventing the occurrence of crack to form a smooth surface of the layer.

Examples of the shell polymers (repeating units) are shown below. The ratio of the monomers in a copolymer means the weight ratio.

(SP-1)

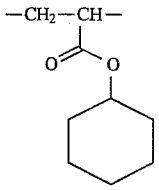

-continued
(SP-2)
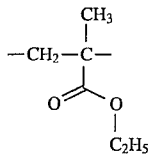
(SP-3)
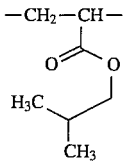
(SP-4)
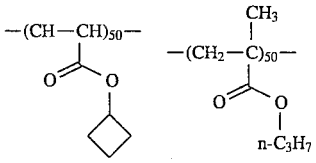
(SP-5)
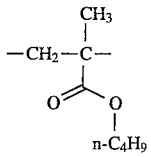
(SP-6)
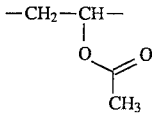
(SP-7)
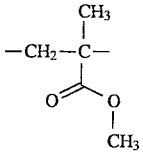
(SP-8)
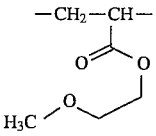
(SP-9)
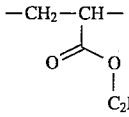
(SP-10)
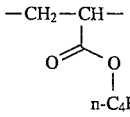
(SP-11)
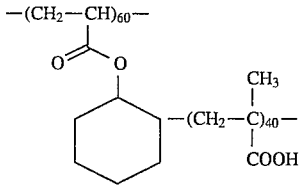
-continued
(SP-12)
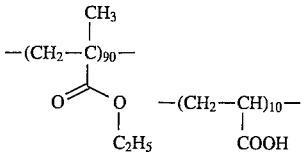
(SP-13)
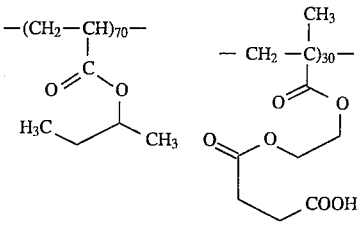
(SP-14)
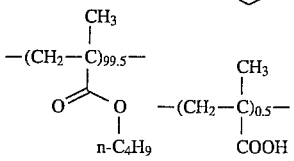
(SP-15)
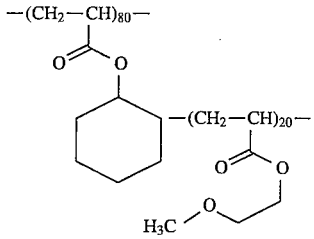
(SP-16)
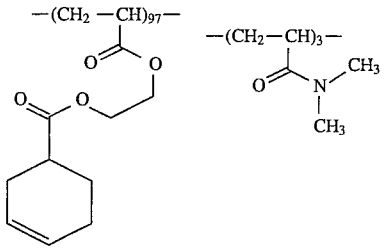
(SP-17)
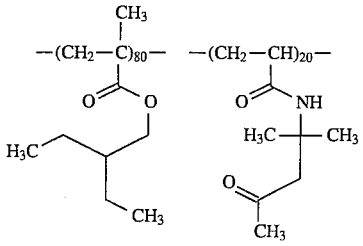
(SP-18)
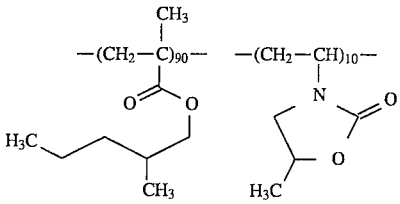
(SP-19)
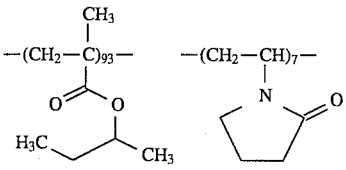

-continued (SP-20)

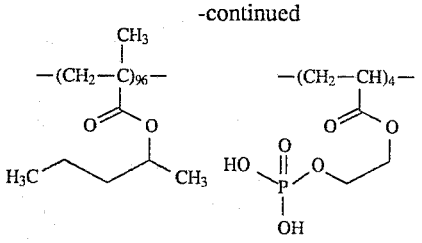

(SP-21)

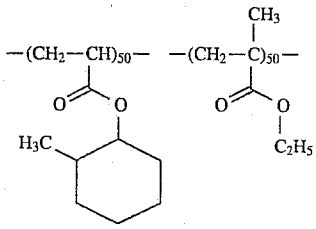

(SP-22)

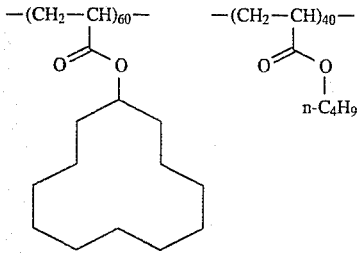

(SP-23)

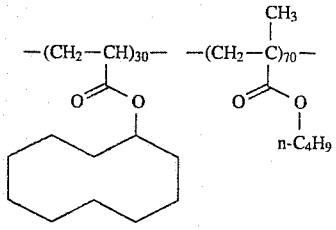

(SP-24)

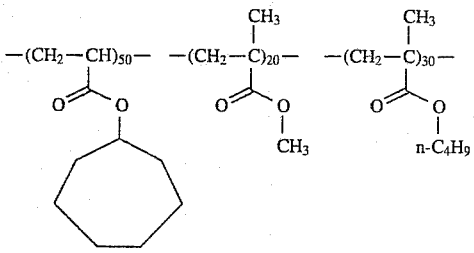

(SP-25)

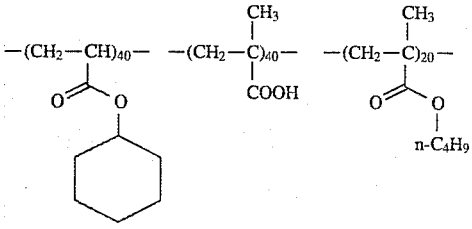

The essentially not cross-linked polymer of the shell preferably has an average molecular weight in the range of 5,000 to 1,000,000, and more preferably in the range of 10,000 to 700,000.

The essentially not cross-linked polymer of the shell has a glass transition temperature preferably in the range of −40° to 140° C., and more preferably in the range of −40° to 100° C.

The core/shell particles preferably have an average particle size in the range of 30 to 500 nm, and more preferably in the range of 50 to 150 nm.

Examples of the core/shell particles are shown in Table 1. In Table 1, the ratio of core/shell means the weight ratio.

TABLE 1

| Core/shell particles | Core polymer | Shell polymer | Ratio of core/shell | Average size |
|---|---|---|---|---|
| CS-1 | CP-1 | SP-1 | 80/20 | 55 nm |
| CS-2 | CP-3 | SP-6 | 70/30 | 60 nm |
| CS-3 | CP-4 | SP-4 | 65/35 | 73 nm |
| CS-4 | CP-6 | SP-12 | 90/10 | 80 nm |
| CS-5 | CP-6 | SP-9 | 95/5 | 62 nm |
| CS-6 | CP-7 | SP-7 | 90/10 | 95 nm |
| CS-7 | CP-7 | SP-11 | 90/10 | 103 nm |
| CS-8 | CP-7 | SP-14 | 80/20 | 133 nm |
| CS-9 | CP-7 | SP-25 | 85/15 | 51 nm |
| CS-10 | CP-8 | SP-12 | 75/25 | 68 nm |
| CS-11 | CP-10 | SP-18 | 65/35 | 74 nm |
| CS-12 | CP-11 | SP-11 | 80/20 | 97 nm |
| CS-13 | CP-12 | SP-11 | 80/20 | 59 nm |
| CS-14 | CP-13 | SP-11 | 80/20 | 110 nm |
| CS-15 | CP-13 | SP-12 | 75/25 | 142 nm |
| CS-16 | CP-13 | SP-14 | 85/15 | 72 nm |
| CS-17 | CP-13 | SP-19 | 55/45 | 70 nm |
| CS-18 | CP-13 | SP-25 | 80/20 | 67 nm |
| CS-19 | CP-14 | SP-11 | 80/20 | 73 nm |
| CS-20 | CP-16 | SP-15 | 60/40 | 82 nm |
| CS-21 | CP-17 | SP-11 | 80/20 | 73 nm |
| CS-22 | CP-20 | SP-20 | 95/5 | 90 nm |
| CS-23 | CP-22 | SP-23 | 75/25 | 120 nm |
| CS-24 | CP-24 | SP-14 | 85/15 | 75 nm |
| CS-25 | CP-25 | SP-11 | 90/10 | 113 nm |

The core/shell particles can be prepared according to a seed emulsion polymerization method. The methods for the core/shell particles are described in ACS Symposium Series 492 (Polymer Latex's) pages 234 to 254 (1992); Research Disclosure No. 30803 (September, 1989); and Kobunshi Ronbunshu, Volume 31, No. 10, pages 575 to 583 (1976), Volume 33, No. 11, pages 663 to 672 (1976), Volume 36, No. 7, pages 459 to 464 (1979). The procedure in the emulsion polymerization is described in Soichi Muroi, Chemistry of Polymer Latex (Kobunshi Kanko-kai).

In the case that the polymer is synthesized by an emulsion polymerization reaction, a surface active agent is preferably used. An anionic surface active agent is more preferably used. Examples of the anionic surface active agents are shown below.

(AS-1)

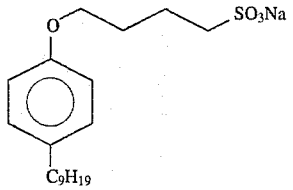

(AS-2)

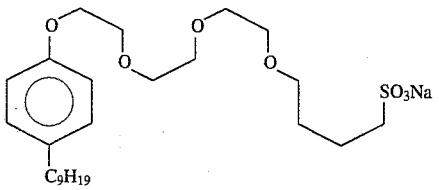

-continued

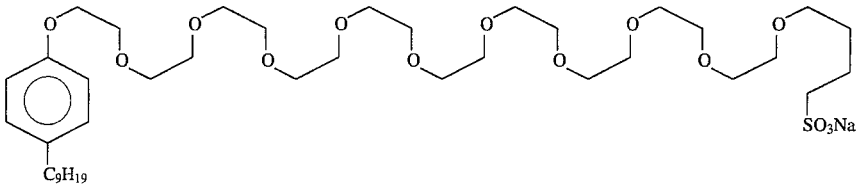

(AS-3)

$C_{12}H_{25}-OSO_3Na$ (AS-4)

$C_{10}H_{21}-OSO_3Na$ (AS-5)

$C_{14}H_{29}-OSO_3Na$ (AS-6)

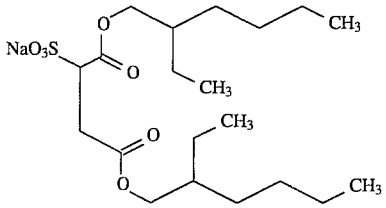

(AS-7)

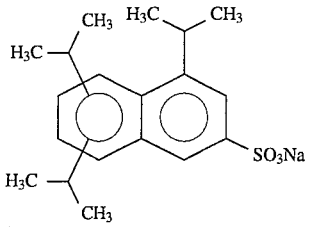

(AS-8)

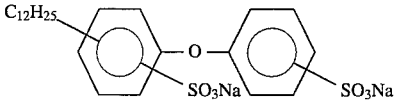

(AS-9)

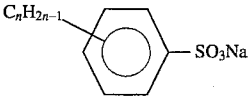

(n = 10 to 16)

(AS-10)

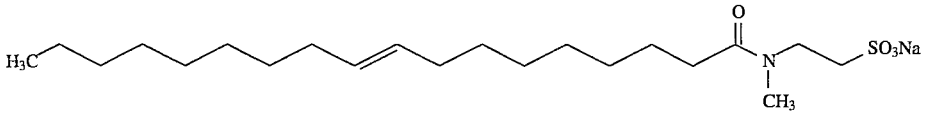

(AS-11)

Synthesis examples of core/shell particles are shown below. The other particles can be synthesized in a similar manner.

SYNTHESIS EXAMPLE 1

Synthesis of cycloocty acrylate

In a glass three neck flask of 300 ml having a disperser, a thermometer and a reflux tube, 80 ml of acetonitrile, 23 g (0.20 mol) of cyclooctanol, 31.1 ml (0.22 mol) of triethylamine, 0.1 g of nitrobenzene and N,N'-dimethylaminopyridine were placed. The mixture was stirred in an ice water bath. To the mixture, 18.15 ml (0.22 mol) of chlorinated acrylic acid was dropwise added. The mixture was stirred at 40° C. for 4 hours.

The mixture was cooled to the room temperature. To the mixture, 100 ml of ethyl acetate and 50 of water were added to cause a phase separation. The ethyl acetate phase was washed with distilled water several times. The phase was purified in a chromatography (support: Wakogel C-200 of Wako Junyaku Co., Ltd., solvent: n-hexane/ethyl acetate =15/1 as volume ratio) to obtain 15.3 g of cyclooctyl acrylate as transparent liquid. The yield was 44%.

SYNTHESIS EXAMPLE 2

Formation of core particle

In a glass three neck flask of 10 liter having a disperser, a thermometer and a reflux tube, 14.4 g of the surface active agent (AS-2) and 4.61 liter of distilled water were placed. The mixture was stirred at 75° C. in a stream of nitrogen. To the mixture, 5.18 g of potassium persulfate dissolved in 120 ml of distilled water was added. Immediately after the addition, a uniformly mixed solution of 1450 g of butyl methacrylate, 8.1 g of methacrylic acid and 162 g of ethyleneglycol dimethacrylate and the solution of 5.18 g of potassium persulfate dissolved in 120 ml of distilled water were constantly dropwise added to the mixture for 3 hours using a constant speed dropping apparatus.

Formation of core/shell particle (CS-21)

After the addition, the mixture was stirred for 1 hour. To the mixture, a uniformly mixed solution of 108 g of cyclohexyl acrylate and 72 g of methacrylic acid and the solution of 1.15 g of potassium persulfate dissolved in 100 ml of distilled water were constantly dropwise added to the mixture for 1 hour using a constant speed dropping apparatus. The mixture was stirred at 75° C. for 2 hours to complete the polymerization reaction.

The reaction mixture was cooled to the room temperature, and filtered off to obtain 6554 g of latex. The solid content was 26.2 wt. %. The pH was 2.8. The average particle size was 62 nm. The yield was 95%.

The hydrophobic backing layer of the present invention is substantially water-resistant because the layer is formed by coating the above-mentioned polymer particles. The substantial water-resistance means that the layer swells 1.3 time or less in the thickness after the layer is immersed in water at 38° C. for 1 minute. The swelling ratio is preferably not more than 1.1 times.

In the case that the hydrophobic backing layer is provided on the anticurl backing layer, the lamination of the layers swells preferably 1.5 times or less, and more preferably 1.45 times or less in the thickness after the lamination is immersed in water at 38° C. for 1 minute. Further, the increase in the thickness after the immersion is preferably not more than 2 μm, and more preferably not more than 1 μm.

The hydrophobic backing layer of the present invention is formed by coating the core/shell particles on the support or another backing layer. The particles are preferably dispersed or emulsified in a medium (e.g., water) to form a coating solution. To the coating solution (namely a dispersion or a latex of the particles), a hardening (cross-linking) agent can be added to introduce a cross-linked structure into the shell polymer as well as the core polymer.

The hydrophobic backing layer of the invention may further contain photographic additives such as a matting agent, a surface active agent, a dye, a slipping agent, an adhesive agent, a UV absorbent, inorganic particles such as colloidal silica. The photographic additives are described in Research Disclosure, volume 176, item 17643, (December 1978).

The hydrophobic backing layer may consist of two or more layers.

The thickness of the hydrophobic backing layer is determined by the function of the layer and the characteristics of the hydrophilic polymer. A very thin layer has a poor function of shielding an anticurl backing layer from processing solutions. On the other hand, a very thick layer inhibits evaporation of water from the anticurl layer to curl the photographic material. The hydrophobic backing layer has a thickness preferably in the range of 0.05 to 10 μm, and more preferably in the range of 0.1 to 5 μm. In the case that the hydrophobic backing layer consists of two or more layers, the above-mentioned thickness means the total thickness of the layers.

The hydrophobic backing layer is provided as the lowermost layer of the photographic material. The layer can be formed according to a conventional coating method. For examples, a coating solution is coated on the other backing layers and dried to form the hydrophobic backing layer. The hydrophobic backing layer can also be formed simultaneously with the formation of the other backing layers according to a simultaneous coating method.

In the silver halide photographic material of the present invention, an anticurl backing layer is preferably provided between a support and the above-mentioned hydrophobic backing layer. The anticurl backing layer usually contain a hydrophilic polymer (hydrophilic colloid) as a binder. The hydrophilic polymer preferably has a hygroscopic property analogous to that of the binders of the silver halide emulsion layers. The preferred hydrophilic polymer is gelatin. Examples of the gelatins include a lime-treated gelatin, an acid-treated gelatin, an enzyme-treated gelatin, a gelatin derivative and a denatured gelatin, which have been conventionally used in photography. The lime-treated gelatin and acid-treated gelatin are preferred. The other hydrophilic colloids are also available as the binder of the anticurl backing layer. Examples of the hydrophilic colloids include proteins, saccharides and synthetic hydrophilic polymers. Examples of the proteins include colloidal albumin and casein. Examples of the saccharides include agar, sodium alginate, starch derivatives and cellulose compounds (e.g., carboxymethyl cellulose, hydroxymethyl cellulose). Examples of the synthetic hydrophilic polymers include polyvinyl alcohol, poly-N-vinylpyrrolidone and polyacrylamide. The synthetic hydrophilic polymer can be used in the form of a copolymer. If an excess amount of hydrophilic repeating unit is used in the copolymer, the hygroscopic amount and rate of the anticurl layer is decreased to degrade the anticurl function. Two or more hydrophilic polymers can be used in combination.

The anticurl backing layer may further contain photographic additives such as a matting agent, a surface active agent, a dye, a cross-linking agent, an adhesive agent, a UV absorbent, inorganic particles such as colloidal silica. The photographic additives are described in Research Disclosure, volume 176, item 17643, (December 1978).

The anticurl backing layer may furthermore contain a polymer latex. The polymer latex contains particles of a water-insoluble polymer dispersed in water. The average size of the particles is preferably in the range of 20 to 200 nm. The dry weight ratio of the polymer latex to the hydrophilic polymer is preferably in the range of 0.01 to 1.0, and more preferably in the range of 0.1 to 0.8. Examples of the monomer units of the polymer latex include alkyl acrylates, hydroxyalkyl acrylates, glycidyl acrylares, alkyl methacrylates, hydroxyalkyl methacrylates and glycidyl methacrylates. The polymer in the latex preferably has an average molecular weight of not less than 100,000, and more preferably in the range of 300,000 to 500,000. Examples of the preferred latex polymers are shown below.

The anticurl backing layer may consist of two or more layers. The thickness of the anticurl backing layer is preferably similar to the thickness of the silver halide emulsion layers. The thickness is generally in the range of 0.2 to 20 μm, and preferably in the range of 0.5 to 10 μm. In the case that the anticurl backing layer consists of two or more layers, the above-mentioned thickness means the total thickness of the layers.

The anticurl backing layer is substantially water-resistant because of the function of the hydrophobic backing layer. The substantial water-resistance means that the anticurl backing layer swells 2 times or less in the thickness after the layer is immersed in water at 38° C. for 1 minute. The swelling ratio is preferably not more than 1.5 times.

The anticurl backing layer can be coated on a support according to conventional processes, such as a dip coating method, an air knife coating method, a curtain coating method, a roller coating method, a wire bar coating method, a gravure coating method, an extrusion coating method and a simultaneous multi-layered coating method. The extrusion method using a hopper is described in U.S. Pat. No. 2,681,294. The simultaneous coating method is described in U.S. Pat. Nos. 2,761,418, 3,508,947 and 2,761,791.

The other backing layers may be provided on the photographic material. The other layers include an undercoating backing layer, an anitistatic backing layer, a matting backing layer and an antihalation backing layer.

The support of the photographic material is described below. Various plastic films are available as the support. Examples of the plastics include cellulose derivatives (e.g., diacetyl cellulose, triacetyl cellulose, propionyl cellulose, butanoyl cellulose, acetyl propionyl cellulose acetate), polyamides, polycarbonates, polyesters (e.g., polyethylene terephthalate, poly-1,4-cyclohexanedimethylene terephthalate, polyethylene 1,2-diphenoxyethane-4,4'-dicarboxylate, polybutylene terephthalate, polyethylene naphthalate), polystyrenes, polypropylenes, polyethylenes, polymethylpentenes, polysulfones, polyethersulfones, polyallylares and polyetherimides.

The support has a thickness preferably in the range of 20 μm to 1 mm, more preferably in the range of 50 to 300 μm, and most preferably in the range of 60 to 200 μm.

There is no specific limitation about silver halide emulsion layers provided on the support.

The shape of silver halide grains may be either in the form of a regular crystal such as cube and octahedron or in the form of an irregular crystal such as globular shape and tabular shape. A grain having a defect of crystalline such as twined crystal is also available. The shape of the grain may be complex of these crystals.

The grain size of the silver halide is usually in the range of 0.2 to 10 μm. With respect to the grain size distribution, a monodispersed emulsion and a polydispersed emulsion are available.

A silver halide emulsion is usually subjected to a physical ripening, a chemical sensitization and a spectral sensitization. The chemical sensitization is preferably conducted by using a gold sensitizer and a sulfur sensitizer. The additives for the physical ripening, the chemical sensitization and the spectral sensitization are described in Research Disclosure Nos. 17643 and 18716.

The other additives for photographic materials are also described in Research Disclosure Nos. 17643 and 18716, as follows.

| Additives | No. 17643 | No. 17643 |
|---|---|---|
| Chemical sensitizers | Page 23 | Page 648, right column |
| Sensitivity increasing agent | | Page 648, right column |
| Spectral sensitizing dye and Supersensitizer | Pages 23 to 24 | Page 648, right column to page 649, right column |
| Breaching agent | Page 24 | |
| Antifogging agent and stabilizer | Page 24 to 25 | Page 649, right column |
| Light absorbing agent, filter dye and ultraviolet absorbent | Pages 25 to 26 | Page 650, right column |
| Stain inhibitor | Page 25, right column | Page 650 |
| Color image stabilizer | Page 25 | |
| Hardening agent | Page 26 | Page 651, right column |
| Binder | Page 26 | Page 651, right column |
| Plasticizer and slip agent | Page 27 | Page 650, right column |
| Coating aid and surface active agent | Pages 26 to 27 | Page 650, right column |

The silver halide photographic material can contain various couplers. The couplers are described in Research Disclosure No. 17643, VII-C to G. The couplers can be introduced into the photographic material according to various known dispersing methods.

The silver halide photographic material of the present invention can be developed according to a conventional method, which described in Research Disclosure Nos. 17643, pages 28 to 29 and 18716, page 615. The present invention is particularly effective in the case that the photographic material is subjected to a rapid development process, a rapid fixing process, a rapid washing process and a rapid drying process. The rapid processes mean that the total time for the processes is in the range of 15 to 60 seconds. The line speed in an automatic developing machine is preferably not less than 1,000 mm per minute.

EXAMPLE 1

Formation of anticurl backing layer

On both surfaces of a polyethylene terephthalate support, undercoating layers were formed. On the back surface of the support, the following solution was coated according to a slide coating method.

| Anticurl backing layer | |
|---|---|
| Gelatin (isoelectric point: 4.8) | 2.5 g/m$^2$ |
| Sodium dodecylbenzenesulfonate | 10 mg/m$^2$ |
| Sodium polystyrenesulfonate | 30 mg/m$^2$ |
| N,N'-ethylbis(vinylsulfonacetamide) | 25 mg/m$^2$ |
| pH (adjusted with 1N hydrochloric acid) | 5.7 |

Formation of hydrophobic backing layer

After the anticurl backing layer was coated, the support was left at 25° C. and at the relative humidity of 65% for one week to harden gelatin by a cross-linking reaction. The following solution was coated on the anticurl backing layer using a wire bar, and dried at 35° C. and at the relative humidity of 30%. The concentration of the polymer in the coating solution was adjusted to 18 wt. %.

| Hydrophobic backing layer | |
|---|---|
| Polymer latex or polymer solution (set forth in Table 2) | 2.0 g/m$^2$ |
| Sodium dodecylbenzenesulfonate | 15.0 mg/m$^2$ |
| Polymethyl methacrylate particles (average particle size: 3 μm) | 10 mg/m$^2$ |
| $C_8F_{17}SO_3K$ | 5 mg/m$^2$ |

Evaluation of samples

The obtained samples were stored at 25° C. and at the relative humidity of 60% for one week. The samples were then evaluated in the following manners.

(1) Swelling ratio of the backing layers

The swelling ratio was measured using an electron micrometer (Anritsu Electric Co., Ltd.). The measuring force before swelling was 30±5 g, and the force after swelling was 2±0.5 g. The measurement was conducted at 38° C.

(2) Recovery from curl

The samples were cut into pieces of 5 cm length and 1 cm width. The pieces were stored at 25° C. and at the relative humidity of 60% for 3 days. Then, they were further stored at 25° C. and at the relative humidity of 10%. The curled value was measured. The curled value and the recovery from curl were determined according to the following formulas.

Curled value=1/{radius of curvature of the sample (cm)}

Recovery of curl={(curled value after 20 seconds)/(curled value after 2 hours)}×100(%)

The recovery of curl is preferably not less than 60% for practical use.

(3) Crack in the coated layers

Crack in the coated layers were observed. The crack was evaluated as the following three grades.

A: No crack was observed.

B: Short cracks (length: 2 mm or less) were observed.

C: Long cracks (length: more than 2 mm) were observed.

(4) Adhesion

The samples were cut into pieces of 5 cm length and 5 cm width. Two pieces were laminated facing the coated layers. The lamination was stored under the pressure of 100 kg/cm$^2$ for 16 hours. The adhesion was then evaluated as the following four grades.

A: Adhered area is 0 to 5%.

B: Adhered area is 5 to 30%.

C: Adhered area is 30 to 60%

D: Adhered area is 60 to 100%.

The results are set forth in Table 2. It is apparent from the results shown in Table 2, the layer formed from the core/shell particles of the present invention effectively reduces swelling of the layers at 38° C., which is the temperature of the processing solutions. The present invention is also effective in recovery from curl and reducing crack and adhesion.

TABLE 2

| Polymer latex | Swelled thickness | Recovery form curl | Occurence of Crack | Adhesion |
|---|---|---|---|---|
| CS-3 | 0.8 μm | 80% | A | B |
| CS-4 | 0.3 μm | 70% | A | B |
| CS-5 | 0.3 μm | 70% | A | B |
| CS-6 | 0.1 μm | 60% | A | A |
| CS-7 | 0.2 μm | 65% | A | B |
| CS-8 | 0.3 μm | 85% | A | B |
| CS-9 | 0.2 μm | 70% | A | B |
| X-1 | 2.0 μm | 85% | A | D |
| X-2 | 2.0 μm | 85% | A | D |
| X-3 | 0.5 μm | 50% | A | B |
| X-4 | 0.1 μm | 70% | C | B |
| X-5 | 0.1 μm | 10% | B | B |
| X-6 | 0.1 μm | 40% | C | A |

The comparative polymer latex X-1 to X-6 are shown below. The polymer latex X-3 is disclosed in European Patent Publication No. 107378A1 (at Example 1). The core polymer and the shell polymer of X-3 have the glass transition temperatures of 78° C. and 33° C. respectively.

(X-1)

Particles consisting of a homopolymer comprising the following repeating unit (average particle size: 110 nm)

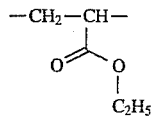

(X-2)

Particles consisting of a homopolymer comprising the following repeating unit (average particle size: 82 nm)

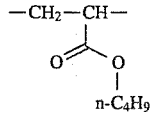

(X-3)

Core/shell particles consisting of the core polymer and the shell polymer (average particle size: 91 nm, core/shell ratio: 90/10)

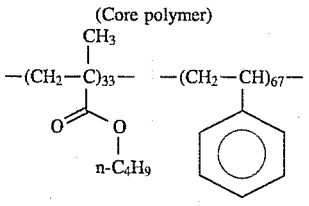

-continued

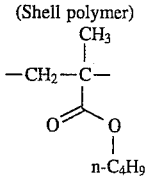

(X-4)

Core/shell particles consisting of the core polymer and the shell polymer (average particle size: 85 nm, core/shell ratio: 90/10)

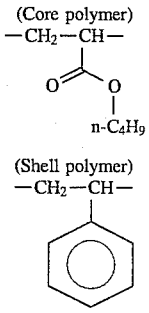

(X-5)

Core/shell particles consisting of the core polymer and the shell polymer (average particle size: 130 nm, core/shell ratio: 87/13)

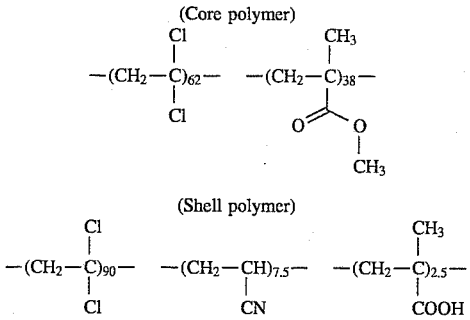

(X-6)

Core/shell particles consisting of the core polymer and the shell polymer (average particle size: 74 nm, core/shell ratio: 90/10)

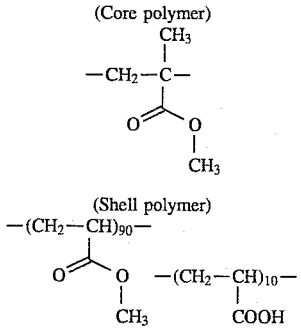

EXAMPLE 2

Formation of backing layers

On both surfaces of a polyethylene terephthalate support (thickness: 100 μm), gelatin undercoating layers were formed. On the back surface of the support, the following solutions for the anticurl backing layer and the hydrophobic backing layer were simultaneously coated according to a slide coating method. In the coating method, the distance between the injector and the support is 0.25 mm, and the conveying speed of the support was 15 m per minute. The solution of the anticurl backing layer was coated at 35° C. The viscosity of the solution at the shearing speed of 10 liter per second was 50 to 6 mPa.s.

| Anticurl backing layer | |
|---|---|
| Gelatin (isoelectric point: 5.7) | 2.5 g/m$^2$ |
| Sodium dodecylbenzenesulfonate | 10 mg/m$^2$ |
| Sodium polystyrenesulfonate | 30 mg/m$^2$ |
| N,N'-ethylenebis(vinylsulfonacetamide) | 25 mg/m$^2$ |
| pH (adjusted with 1N hydrochloric acid) | 5.7 |
| **Hydrophobic backing layer** | |
| Polymer latex (set forth in Table 3) | 2.0 g/m$^2$ |
| Glycerol triglycidyl ether | 0.4 g/m$^2$ |
| Sodium dodecylbenzenesulfonate | 15.0 mg/m$^2$ |
| Polymethyl methacrylate particles | 10 mg/m$^2$ |
| $C_8F_{17}SO_3K$ | 5 mg/m$^2$ |

Evaluation of samples

After coating the hydrophobic backing layer, the support was air-dried in a chilling zone at the dry-bulb temperature of 20° C. and at the wet-bulb temperature of 15° C. to cause gelation of the coated layers. The support was further air-dried at the dry-bulb temperature of 35° C. and at the wet-bulb temperature of 20° C.

The obtained samples were stored at 25° C. and at the relative humidity of 60% for one week. The swelling ratio, recovery from curl, crack and adhesion were evaluated in the same manner as in Example 1.

The results are set forth in Table 3. It is apparent from the results shown in Table 3, the layer formed from the core/shell particles the present invention effectively improves the water-resistance and prevents the adhesion and the crack even in the case that the anticurl backing layer and the hydrophobic backing layer are simultaneously coated.

TABLE 3

| Polymer latex | Swelled thickness | Recovery form curl | Occurence of crack | Adhesion |
|---|---|---|---|---|
| CS-1 | 0.9 μm | 60% | A | B |
| CS-12 | 0.7 μm | 60% | A | B |
| CS-13 | 0.5 μm | 60% | A | B |
| CS-14 | 0.3 μm | 60% | A | B |
| CS-19 | 0.3 μm | 60% | A | B |
| CS-21 | 0.3 μm | 80% | A | B |
| CS-25 | 0.3 μm | 60% | A | B |
| CS-15 | 0.4 μm | 80% | A | B |
| CS-16 | 0.3 μm | 70% | A | B |
| CS-17 | 0.3 μm | 65% | A | B |
| CS-18 | 0.3 μm | 60% | A | B |
| X-3 | 0.8 μm | 55% | B | B |
| X-7 | 1.2 μm | 60% | A | B |
| X-8 | 1.5 μm | 80% | A | C |
| X-9 | 2.0 μm | 70% | B | B |
| X-10 | 2.0 μm | 70% | B | B |
| X-11 | 2.0 μm | 70% | B | B |
| X-12 | 1.5 μm | 60% | A | B |

The comparative polymer latex X-3 is shown in Example 1. The other comparative polymer latex X-7 to X-12 are shown below.

(X-7)

Particles consisting of a homopolymer comprising the following repeating unit (average particle size: 93 nm)

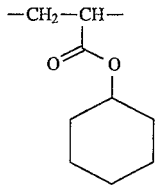

(X-8)

Particles consisting of a homopolymer comprising the following repeating unit (average particle size: 76 nm)

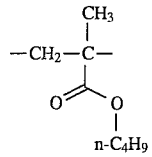

(X-9)

Particles consisting of a copolymer comprising the following repeating units (average particle size: 101 nm)

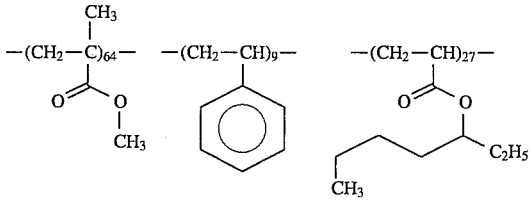

(X-10)

Particles consisting of a copolymer comprising the following repeating units (average particle size: 52 nm)

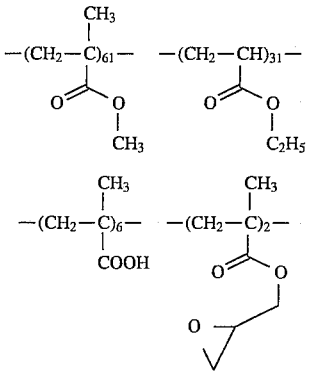

(X-11)

Core/shell particles consisting of the core polymer and the shell polymer (average particle size: 105 nm, core/shell ratio: 90/10)

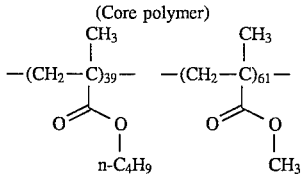

-continued (Shell polymer)

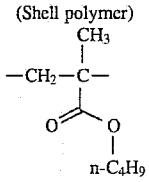

(X-12)

Core/shell particles consisting of the core polymer and the shell polymer (average particle size: 88 nm, core/shell ratio: 80/20)

(Core polymer)

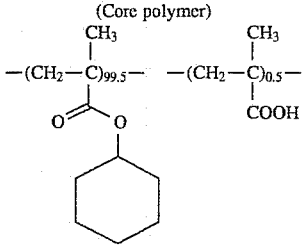

(Shell polymer)

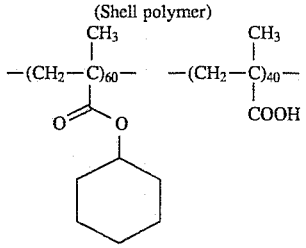

EXAMPLE 3

Formation of first undercoating layer

On both surfaces of a biaxially stretched polyethylene terephthalate support (thickness: 100 μm), the following solution was coated and dried at 180° C. for 2 minutes to form first undercoating layers having the dry thickness of 0.9 μm.

| First undercoating layer | |
|---|---|
| Aqueous dispersion of vinylidene chloride/methyl methacrylate/acrylonitrile/methacrylic acid copolymer (weight ratio: 90/8/1/1) | 15 weight parts |
| 2,4-Dichloro-6-hydroxy-s-triazine | 0.25 weight part |
| Polystyrene particles (average particle size: 3 μm) | 0.05 weight part |
| The following compound 1 | 0.20 weight part |
| Water | to make up to 100 weight parts |
| pH (adjusted with 10 wt. % KOH) | 6 |

(Compound 1)

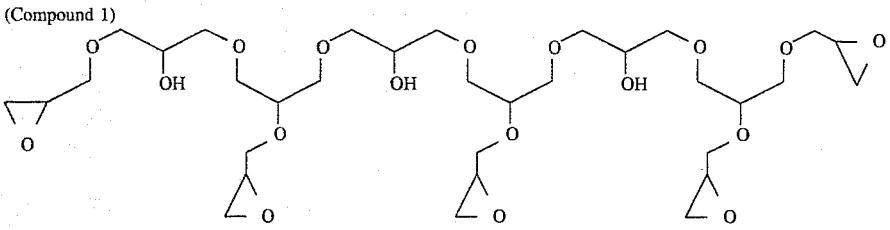

Formation of second undercoating layer

On both surfaces of the first undercoating layers, the following solution was coated and dried at 170° C. for 2 minutes to form second undercoating layers having the dry thickness of 0.1 μm.

| Second undercoating layer | |
|---|---|
| Gelatin | 1 weight part |
| Methyl cellulose | 0.05 weight part |
| The following compound 2 | 0.02 weight part |
| $C_{12}H_{25}O(CH_2CH_2O)_{10}H$ | 0.03 weight part |
| The following compound 3 | $3.5 \times 10^{-3}$ weight part |
| Acetic acid | 0.2 weight part |
| Water | to make up to 100 weight parts |

(Compound 2)

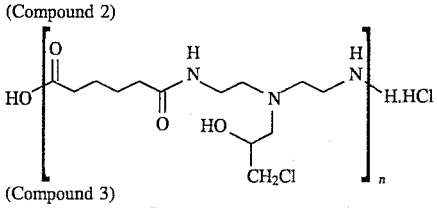

(Compound 3)

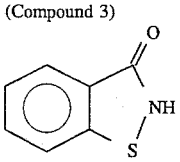

Formation of antistatic backing layer

On the back surface of the second undercoating layer, the following solution was coated to form an antistatic backing layer (surface resistance: $2\times10^{10}$ Ω at 25° C. and at the relative humidity of 10%).

| Antistatic backing layer | |
|---|---|
| $SnO_2$/Sb (weight ratio: 9/1, average particle size: 0.25 μm) | 300 mg/m$^2$ |
| Gelatin ($Ca^{++}$ content: 30 ppm) | 170 mg/m$^2$ |
| The compound 3 | 7 mg/m$^2$ |
| Sodium dodecylbenzenesulfonate | 10 gm/m$^2$ |

-continued

| Antistatic backing layer | |
|---|---|
| Sodium dihexyl-α-sulfosuccinate | 40 mg/m$^2$ |
| Sodium polystyrenesulfonate | 9 mg/m$^2$ |

Formation of backing layers

On the antistatic backing layer, an anticurl backing layer and a hydrophobic backing layer were formed in the same manner as in Example 2. The details of the backing layers are set forth in Table 4.

Formation of emulsion layers

On the reverse surface of the support (on which the backing layers were not provided), a dye layer, an emulsion layer, a lower protective layer and an upper protective layer (shown in example 3 of Japanese Patent Provisional Publication No. 5(1993)-127282) were coated to prepare samples.

FIG. 1 is a sectional view schematically illustrating the layered structure of the prepared sample. As is shown in FIG. 1, first undercoating layers (2) are provided on a support (1). Second undercoating layers (3) are provided on the first undercoating layers (2). On the back surface of the second coating layer (3), an antistatic backing layer (4) is provided. Further, an anticurl backing layer (5) is provided on the antistatic backing layer (4). Furthermore, a hydrophobic backing layer (5) is provided on the anticurl backing layer. On the reverse surface of the second coating layer (3), a dye layer (7) is provided. Further, a silver halide emulsion layer (8) is provided on the dye layer (7). Furthermore, a lower protective layer (9) and an upper protective layer (10) are provided on the silver halide emulsion layer (8).

Evaluation of samples

The samples were stored at 25° C. and at the relative humidity of 60% for one week. The samples were then evaluated in the following manner.

(1) Swelling ratio of the backing layers

After the following washing process, the samples were freeze-dried in liquid nitrogen. The slice of the sample was observed by a scanning electron microscope to determine the thickness (d) of the anticurl backing layer or the hydrophobic backing layer.

Further, after the following drying process, the slice of the sample was observed by a scanning electron microscope to determine the thickness ($d_0$) of the anticurl backing layer or the hydrophobic backing layer.

(2) Swelling ratio of the emulsion layer and the protective layer

The swelling ratio was measured using an electron micrometer (Anritsu Electric Co., Ltd.). The measuring force before swelling was 30±5 g, and the force after swelling was 2±0.5 g. The measurement was conducted at 38° C.

(3) Recovery from curl

The samples were cut into pieces of 5 cm length and 1 cm width. The pieces were stored at 25° C. and at the relative humidity of 60% for 3 days. Then, they were further stored at 25° C. and at the relative humidity of 10%. The curled value was measured. The curled value was determined according to the following formula.

$$\text{Curled value}=1/\{\text{radius of curvature of the sample (cm)}\}$$

The plus value means that the material is curled toward the side of the emulsion layer. The minus value means that the material is curled toward the side of the backing layers. The practically tolerable curled value is in the range of −0.02 to +0.02.

(4) Drying rate

The samples of a large full size (51 cm×61 cm) were developed at 25° C. and at the relative humidity of 60° C. in an automatic developing machine (FG-710NH, Fuji Photo Film Co., Ltd.). The drying process in the machine was conducted at 50° C. while changing the line speed. The minimum time required for drying the sample completely was determined.

(5) Jamming

The rollers in the drying part of the above-mentioned automatic developing machine were replaced with smooth rollers made of a phenol resin. Then 12 pieces of the samples of 10×12 inch size were processed under the following conditions. Then the jamming of the samples was observed.

(6) Resistance to solvent

The backing surface of the sample was rubbed with an applicator wetted with acetone ten times. The sample was then immersed in 0.5% aqueous solution of crystal violet lactone. The damage of the polymer layer was evaluated as the following three grades.

A: No damage was observed or a trace of scratch was observed (the layer was not dyed with crystal violet lactone).

B: The polymer layer was not dissolved, but scratch was remarkably observed (the layer was dyed with crystal violet lactone along the scratch).

C: The polymer layer was dissolved in acetone (the layer was completely dyed with crystal violet lactone).

| Process | | |
|---|---|---|
| Development | 38° C. | 14.0 seconds |
| Fixing | 38° C. | 9.7 seconds |
| Washing | 25° C. | 9.0 seconds |
| Squeezing | | 2.4 seconds |
| Drying | 55° C. | 8.3 seconds |
| Total | | 43.4 seconds |
| Line speed | | 2,800 mm/minute |

The developing solution and the fixing solution were shown below. The amount of the replenisher was 200 ml per 1 m$^2$ of the film.

| Developing solution (processing temperature: 38° C.) | | |
|---|---|---|
| Sodium 1,2-dihydroxybenzene-3,5-disulfonate | | 0.5 g |
| Diethylenetriaminetetraacetic acid | | 2.0 g |
| Sodium carbonate | | 5.0 g |
| Boric acid | | 10.0 g |
| Potassium sulfite | | 85.5 g |
| Sodium bromide | | 6.0 g |
| Diethylene glycol | | 40.0 g |
| 5-Methylbenzotriazole | | 0.2 g |
| Hydroquinone | | 30.0 g |
| 4-Hydroxymethyl-4-methyl-1-phenyl-3-pyrazolidone | | 1.6 g |
| 2,3,5,6,7,8-hexahydro-2-thioxo-4-(1H)-quinazolidone | | 0.05 g |
| Sodium 2-mercaptobenzimidazole-5-sulfonate | | 0.3 g |
| Water | to make up to | 1 liter |
| pH (adjusted with potasium hydroxide) | | 10.7 |

| Fixing solution (processing temperature: 38° C.) | |
|---|---|
| Sodium thiosulfate | 160 g per liter |
| 1,4,5-Trimethyl-1,2,4-triazorium-4-thiorate | 0.25 mol per liter |
| Sodium bisulfite | 30 g per liter |
| Dihydric salt of disodium ethylenediaminetetraacetic acid | 0.25 mol per liter |
| pH (adjusted with sodium hydroxide) | 6.0 |

The results are set forth in Table 4. It is apparent from the results shown in Table 4 that the prevent invention improves the drying speed and the recovery from curl. Further, the samples of the invention do not cause the problems of jamming. The polymer was prepared in the same manner as in the synthesis example 2, except that the surface active agent (surfactant) was changed as is shown in Table 4. The hydrophobic backing layer was not provided on the last sample.

TABLE 4

| | (1) | | (2) | (3) | (4) | (5) | (6) |
|---|---|---|---|---|---|---|---|
| Latex | ACB | HPB | Swell | Curl | Dry | Jam | Solv. |
| CS-1 | 1.3 | 1.0 | 200 | 0.02 | 16 | – | B |
| CS-12 | 1.2 | 1.0 | 200 | 0.02 | 15 | – | B |
| CS-13 | 1.2 | 1.0 | 200 | 0.02 | 15 | – | B |
| CS-14 | 1.1 | 1.0 | 200 | 0.02 | 14 | – | A |
| CS-19 | 1.1 | 1.0 | 200 | 0.02 | 14 | – | A |
| CS-21 | 1.1 | 1.0 | 200 | 0.00 | 14 | – | A |
| CS-25 | 1.1 | 1.0 | 200 | 0.02 | 14 | – | A |
| CS-15 | 1.2 | 1.0 | 200 | 0.00 | 15 | – | B |
| CS-16 | 1.1 | 1.0 | 200 | 0.01 | 14 | – | A |
| CS-17 | 1.1 | 1.0 | 200 | 0.01 | 14 | – | A |
| CS-18 | 1.1 | 1.0 | 200 | 0.02 | 14 | – | A |
| X-7 | 1.5 | 1.0 | 200 | 0.02 | 18 | + | C |
| X-8 | 1.9 | 1.0 | 200 | 0.01 | 20 | + | C |
| X-9 | 2.7 | 1.0 | 200 | 0.01 | 26 | + | C |

(Remark)
ACB: The ratio ($d/d_0$) of the anticurl backing layer
HPB: The ratio ($d/d_0$) of the hydrophobic backing layer
Dry: Time required for drying the sample (second)
Jam: Jamming observed (+) or not observed (–)
The comparative polymer latex X-7 to X-9 are shown in Example 2.

We claim:

1. A silver halide photographic material comprising a silver halide emulsion layer and a hydrophobic backing layer provided on a support, said hydrophobic backing layer being formed by coating core/shell polymer particles, wherein the core comprises a cross-linked polymer, having a glass transition temperature in the range of 10° C. to 65° C. and the shell comprises an essentially not cross-linked polymer.

2. The silver halide photographic material as claimed in claim 1, wherein the cross-linked polymer of the core is made from a monomer having one ethylenically unsaturated group and another monomer having two or more ethylenically unsaturated groups.

3. The silver halide photographic material as claimed in claim 2, the monomer having two or more ethylenically unsaturated groups is used in the amount of 1 to 35 wt. % based on the total amount of the monomers.

4. The silver halide photographic material as claimed in claim 2, wherein the monomer having two or more ethylenically unsaturated groups is an ester of a diol or a triol with acrylic acid or methacrylic acid.

5. The silver halide photographic material as claimed in claim 2, wherein the monomer having two or more ethylenically unsaturated groups is divinylbenzene, N,N'-alkylenebisacrylamide or N,N'-alkylenebismethacrylamide.

6. The silver halide photographic material as claimed in claim 2, wherein the monomer having two or more ethylenically unsaturated groups is ethyleneglycol dimethacrylate, divinylbenzene, N,N'-methylenebisacrylamide, trimethylolpropane trimethacrylate, triethyleneglycol dimethacrylate, tetraethyleneglycol dimethacrylate or 1,3-butanediol dimethacrylate.

7. The silver halide photographic material as claimed in claim 2, wherein the monomer having one ethylenically unsaturated group further has an alicyclic group having 3 to 16 carbon atoms.

8. The silver halide photographic material as claimed in claim 2, wherein the monomer having one ethylenically unsaturated group further has an alkyl group having 1 to 6 carbon atoms.

9. The silver halide photographic material as claimed in claim 1, wherein the cross-linked polymer of the core has a glass transition temperature in the range of 20° to 50° C.

10. The silver halide photographic material as claimed in claim 1, wherein the amount of the core is in the range of 50 to 98 wt. % based on the amount of the particle.

11. The silver halide photographic material as claimed in claim 1, wherein the essentially not cross-linked polymer of the shell has carboxyl, a heterocyclic group, an ester bond or an amido bond in its side chain.

12. The silver halide photographic material as claimed in claim 1, wherein the essentially not cross-linked polymer of the shell has an average molecular weight in the range of 5,000 to 1,000,000.

13. The silver halide photographic material as claimed in claim 1, wherein the essentially not cross-linked polymer of the shell has a glass transition temperature in the range of –40° to 140° C.

14. The silver halide photographic material as claimed in claim 1, wherein the particles have an average particle size in the range of 30 to 500 nm.

15. The silver halide photographic material as claimed in claim 1, wherein the hydrophobic backing layer has a thickness in the range of 0.05 to 10 μm.

16. The silver halide photographic material as claimed in claim 1, wherein an anticurl backing layer is provided between the support and the hydrophobic backing layer.

* * * * *